US007086606B2

(12) United States Patent
Brooks et al.

(10) Patent No.: US 7,086,606 B2
(45) Date of Patent: Aug. 8, 2006

(54) MODULAR FUEL INJECTOR WITH DI-POLE MAGNETIC CIRCUIT

(75) Inventors: Harry R. Brooks, Newport News, VA (US); Michael P. Dallmeyer, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 218 days.

(21) Appl. No.: 10/863,250

(22) Filed: Jun. 9, 2004

(65) Prior Publication Data

US 2005/0006492 A1 Jan. 13, 2005

Related U.S. Application Data

(60) Provisional application No. 60/477,484, filed on Jun. 10, 2003.

(51) Int. Cl.
*F02D 1/06* (2006.01)

(52) U.S. Cl. ..... 239/5; 239/585.1; 239/585.3; 239/585.4; 239/585.5; 239/900; 251/129.15; 251/129.16

(58) Field of Classification Search ..... 239/5, 239/585.1, 585.3, 585.4, 585.5, 900; 251/129.15, 251/129.16, 129.18, 129.21
See application file for complete search history.

(56) References Cited

U.S. PATENT DOCUMENTS

| | | | | |
|---|---|---|---|---|
| 1,323,778 | A | 12/1919 | Lemp | |
| 1,754,740 | A | 4/1930 | Clarkson | |
| 3,773,265 | A | 11/1973 | Kent | |
| 4,395,988 | A * | 8/1983 | Knapp et al. | 123/469 |
| 4,477,027 | A | 10/1984 | Knapp et al. | |
| 4,597,558 | A | 7/1986 | Hafner et al. | |
| 5,154,350 | A | 10/1992 | Ausiello et al. | |
| 5,192,048 | A * | 3/1993 | Wakeman | 251/129.16 |
| 5,238,224 | A | 8/1993 | Horsting | |
| 5,299,776 | A | 4/1994 | Brinn, Jr. et al. | |
| 5,341,994 | A | 8/1994 | Wakeman | |
| 5,417,373 | A | 5/1995 | Facchin | |
| 5,570,842 | A | 11/1996 | Kindley | |
| 5,634,596 | A | 6/1997 | Abiko | |
| 5,749,527 | A | 5/1998 | Fujikawa et al. | |

(Continued)

FOREIGN PATENT DOCUMENTS

EP 0504806 A2 3/1992

OTHER PUBLICATIONS

PCT International Search Report filed Sep. 6, 2004 (PCT/US2004/018347) and date of mailing Oct. 20, 2004.

*Primary Examiner*—Dinh Q. Nguyen

(57) ABSTRACT

A modular fuel injector for an internal combustion engine, including a valve group subassembly and a power group subassembly. The valve group subassembly includes a first stator member, a second stator member, a non-magnetic shell disposed between the first and second stator members, a valve body, and an armature member. The armature member defines a first working air gap with the first stator member and a second working air gap with the second stator member. The armature member includes a closure member proximate an outlet end and contiguous to a seat in a first configuration. The power group subassembly includes an electromagnetic coil surrounding the passage, a housing encasing the coil, and an ovemold encapsulating the coil and the housing. The coil is energizable to provide magnetic flux that flows through the first and second working air gaps in the direction of the longitudinal axis.

19 Claims, 3 Drawing Sheets

U.S. PATENT DOCUMENTS 5,794,860 A 8/1998 Neumann
5,918,818 A 7/1999 Takeda
5,937,887 A 8/1999 Baxter et al.
6,079,642 A 6/2000 Maier
6,481,646 B1 11/2002 Hornby
6,499,668 B1 12/2002 Dallmeyer et al.

* cited by examiner

MODULAR FUEL INJECTOR WITH DI-POLE MAGNETIC CIRCUIT

CROSS REFERENCE TO CO-PENDING APPLICATIONS

This application claims the benefit of the earlier filing date of U.S. Provisional Application No. 60/477,484 filed Jun. 10, 2003, entitled "Modular Injector with Di-Pole Magnetic Circuit" and having inventors Michael P. Dallmeyer and Harry R. Brooks, which Provisional Application is incorporated by reference herein in its entirety.

BACKGROUND OF THE INVENTION

A known electromagnetic actuator for an electromagnetic fuel injector includes a stator member, an armature member, a valve body formed of magnetic material, and an electromagnetic coil. The electromagnetic coil is energizable to flow magnetic flux through a magnetic circuit. The magnetic circuit includes the stator member, the armature member, and the valve body. The magnetic flux flows through a working air gap defined by the armature member and the stator member, and creates a magnetic force that attracts the armature member to the stator member. The air gap is a working air gap because magnetic flux flowing through the air gap produces useful work. The armature member is disposed in the valve body and is guided by an inner surface of the valve body during reciprocal movement toward and away from the stator member. The armature member and the inner surface of the valve body, by their radially facing orientation, define a non-working air gap (i.e. a parasitic air gap) that adds reluctance to the magnetic circuit. The air gap is a parasitic air gap because the magnetic flux flowing through the air gap does not produce useful work and also incur magnetic losses in the circuit. One example of a modular fuel injector with a parasitic gap is shown and described in U.S. Pat. No. 6,481,646, the entirety of which is incorporated by reference herein.

SUMMARY OF THE INVENTION

In an embodiment, the invention provides a modular fuel injector for an internal combustion engine. The modular fuel injector includes a power group subassembly secured to a valve group subassembly. The power group subassembly includes a housing, an electromagnetic coil and an overmold. The housing encases an electromagnetic coil. The overmold surrounds the coil and the housing. The valve group subassembly includes first and second stator members, a non-magnetic shell, a valve body, an armature member, and a seat. The first stator member defines a fluid passage extending along a longitudinal axis. The non-magnetic shell is disposed between the first and second stator members. The valve body is coupled to the second stator member and includes a securement that secures the valve body to the coil housing. The armature member is disposed in the valve body and coupled to a closure member for movement with respect to the first and second stator members between a first configuration with a closure member contiguous to a seat in the first configuration and spaced from the seat in the second configuration. The armature member includes an armature surface with at least a portion contiguous to a plane intersecting the longitudinal axis. A first portion of the armature surface confronts the first stator member to define a first working gap from the armature surface to the first stator member along the longitudinal axis.

A second portion of the armature surface confronts the second stator member to define a second working gap from the armature surface to the second stator member along the longitudinal axis.

In yet another embodiment, the invention provides a method of manufacturing a modular fuel injector. The method can be achieved by providing a valve group subassembly, providing a power group subassembly, inserting the valve group subassembly into the power group subassembly and securing the valve group subassembly to the power group subassembly. The power group subassembly, as provided, includes a housing, an electromagnetic coil and an overmold. The housing encases an electromagnetic coil. The overmold surrounds the coil and the housing. The valve group subassembly, as provided, includes first and second stator members, a non-magnetic shell, a valve body, an armature member, and a seat. The first stator member defines a fluid passage extending along a longitudinal axis. The non-magnetic shell is disposed between the first and second stator members. The armature member is disposed in the valve body and coupled to a closure member for movement with respect to the first and second stator members between a first configuration with a closure member contiguous to a seat in the first configuration and spaced from the seat in the second configuration. The armature member includes an armature surface with at least a portion contiguous to a plane intersecting the longitudinal axis. A first portion of the armature surface confronts the first stator member to define a first working gap from the armature surface to the first stator member along the longitudinal axis. A second portion of the armature surface confronts the second stator member to define a second working gap from the armature surface to the second stator member along the longitudinal axis.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Fuel injectors are used to provide a metered amount of fuel to an internal combustion engine. Details of the operation of the modular fuel injector 10 in relation to the operation of the internal combustion engine (not shown) are well known and will not be described in detail herein, except as the operation relates to the preferred embodiments.

Figure 1:
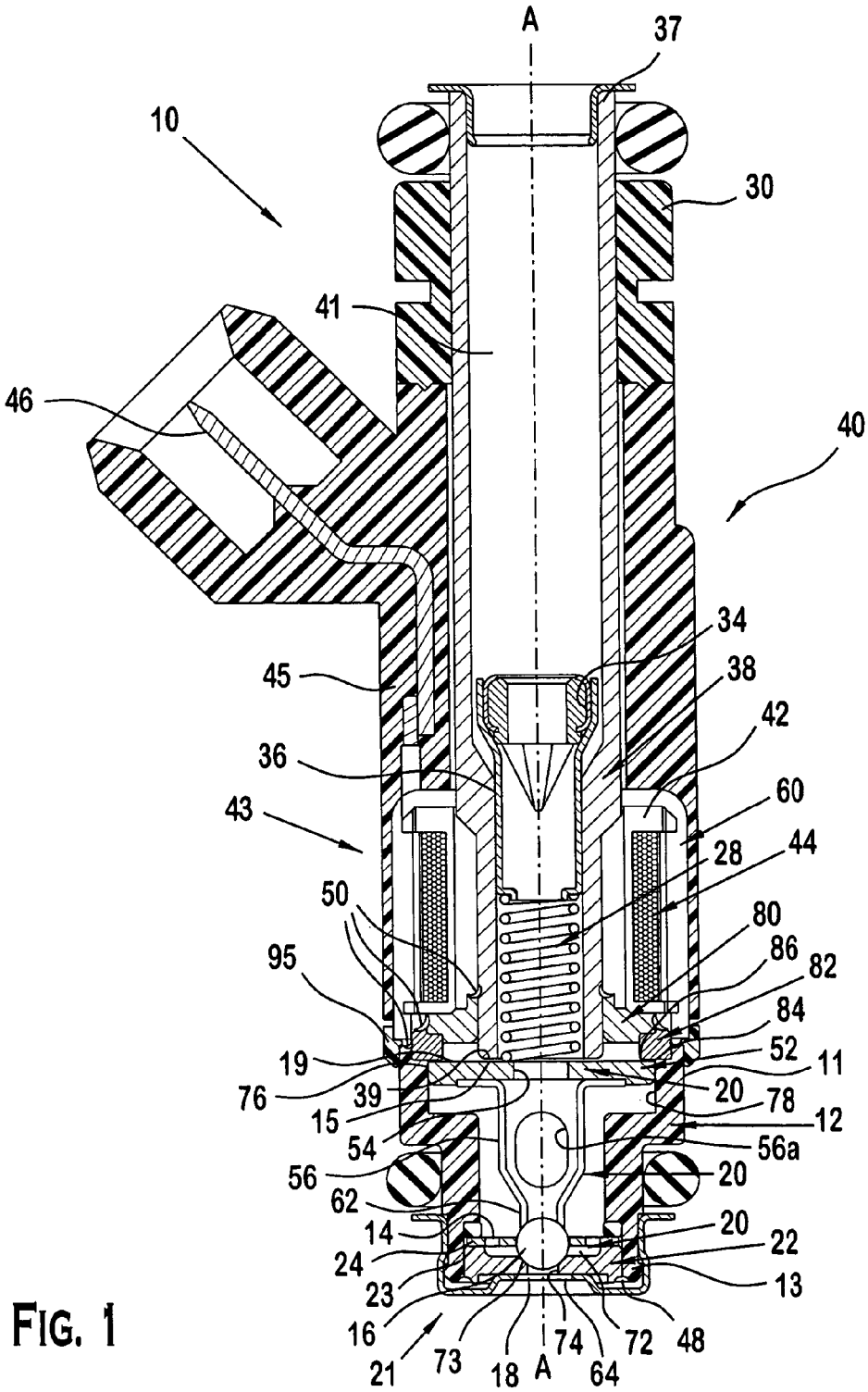
FIG. 1 is a cross-sectional view of a preferred embodiment showing a modular electromagnetic fuel injector that are assembled from power group and valve group subassemblies, which provide a magnetic circuit having a first working air gap and a second working air gap.

Referring now to FIG. 1, there is shown the modular fuel injector 10, according to a preferred embodiment. As used herein, like numerals indicate like elements throughout. The modular fuel injector 10 includes a valve group subassembly 21, also illustrated in FIG. 2, having a valve body 12 with an upstream end 11, a downstream end 13, and a longitudinal axis A—A extending therethrough. The words "upstream" and "downstream" designate flow directions in the drawing to which reference is made. The upstream end is defined to mean in a direction toward the top of the figure referred, and the downstream end is defined to mean in a direction toward the bottom of the figure.

The valve group 21 includes an armature assembly 20 that is reciprocally disposed within the valve body 12 along the longitudinal axis A—A. The valve group 21 further includes an inlet tube 38, having an upstream end 37, a downstream end 39, and an inlet tube channel 41. The upstream end 37 can be provided with an O-ring retainer to retain an O-ring. The downstream end 39 of the inlet tube 38 is connected to the upstream end 11 of the valve body 12 via a non-magnetic shell 80 and a magnetic stop member 82. A suitable technique can be used to secure the components, such as hermetic laser welds 50.

The downstream end 39 of the inlet tube 38 is spaced a predetermined distance from upstream end 19 of the armature assembly 20. This predetermined distance, as measured from the downstream end 39 to the upstream end 19 along the longitudinal axis A—A, represents a first working air gap 15. The downstream end 84 of the magnetic stop member 82 is spaced a predetermined distance from the upstream end 19 of the armature assembly 20 along the longitudinal axis A—A. This predetermined distance represents a second working air gap 86. A spring 28, is disposed at the downstream end 39 of the inlet tube 38, upstream of the armature assembly. An adjusting tube 36 is disposed a predetermined distance into the channel 41 of the inlet tube 38. The adjusting tube 36 compresses the spring 28. The compression of the spring 28 biases the armature assembly 20 to a closed position to preclude fuel flow.

A seat 22 and a lower guide 24 are provided within the valve body 12. The lower guide 24 is located upstream from the seat 22. Both the lower guide 24 and seat 22 are located downstream of the armature assembly 20 along the longitudinal axis A—A. The lower guide 24 has a plurality of apertures 14 that extend therethrough. The plurality of apertures 14 in the lower guide 24 are disposed circumferentially about the longitudinal axis A—A. The seat 22 has a generally recessed area 72 extending down from the upper surface 23 of the seat 22, and a generally circular opening 74 extending along the longitudinal axis A—A. A seating surface 73 extends between the recessed area 72 and the opening 74, and is in the form of a conic frustum. A hermetic weld 48, located at the downstream end 13 of the valve body 12, seals the seat 22 at the valve body 12.

The lower guide 24 guides a downstream end 62 of the armature assembly 20, in the valve body 12, along the longitudinal axis A—A. An orifice disk 18 is disposed downstream of the seat 22. An orifice 64 is provided within the orifice disk 18. The orifice 64 preferably extends through the geometric center of the orifice disk 18 along the longitudinal axis A—A. Alternatively, the orifice 64 can be offset from the axis A—A. A retainer proximate the orifice disk 18 can be used to retain an O-ring.

A fuel filter 34 is disposed in the inlet tube channel 41. The fuel filter 34 removes particulate (not shown) in the fuel that passes through the modular fuel injector 10.

The armature assembly 20 includes a ball 16 welded to the downstream end 62 of an armature tube 56. An armature surface can be coupled to the armature tube 56. Preferably, the armature surface is a generally planar, generally circular magnetic disk 52 that extends radially from an upstream end of the armature tube 56. An interior surface 78 of the valve body 12 acts as a guide 76 for side surface 94 of the disk 52. The interior surface 78 and the lower guide 24 orients the reciprocal operation of the armature assembly 20 within the valve body 12 along the longitudinal axis A—A.

The modular fuel injector 10 further includes a power group subassembly 40. The power group subassembly 40 includes a coil assembly 43 that cinctures the inlet tube 38. The coil assembly 43 includes a plastic bobbin 42 and terminals 46. Coil wire 44 is wound around the plastic bobbin 42. The terminals 46 are bent to a desired position as shown in FIG. 1. A coil housing 60 encases the coil assembly 43. The coil assembly 43 and housing 60 are then overmolded with a plastic overmold 45 or any other equivalent formable material thereof. The power group subassembly can be assembled as a separate subassembly from the valve group subassembly and tested before being assembled with the valve group subassembly.

The valve group subassembly 21 may be assembled and tested as a separate part, and then assembled to the power group subassembly 40. The valve group subassembly 21, including the valve body 12, the armature assembly 20, the inlet tube 38, the non-magnetic shell 80 and the magnetic stop member 82, may be inserted into the downstream end of the power group subassembly 40 such that the non-magnetic shell contacts the downstream end of the plastic bobbin 42. A first securement 30 can secure an upstream end of the inlet tube 38 to the overmold 45, and a second securement 95 can secure the valve body 12 to the coil housing by a suitable retention technique such as, for example, welding, bonding or fusing the members together.

Figure 2:
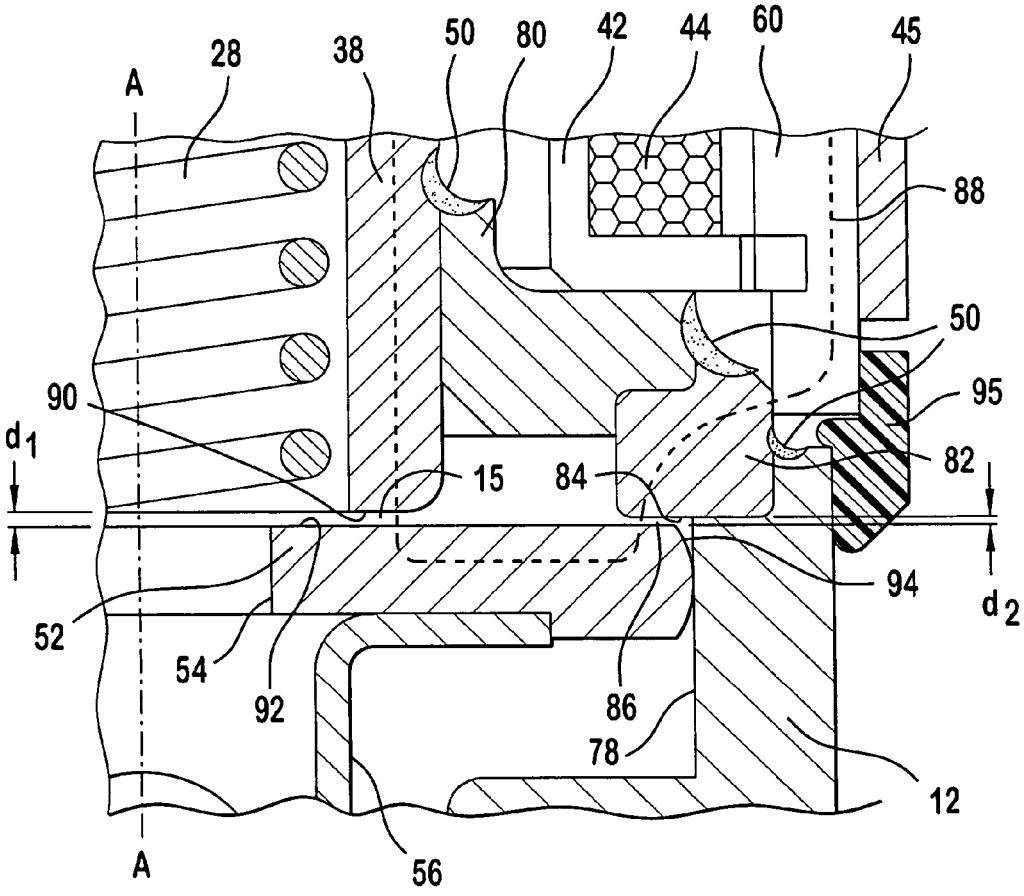
FIG. 2 is an enlarged view of various components of the modular fuel injector including a first working air gap and the second working air gap of FIG. 1.
Figure 3:
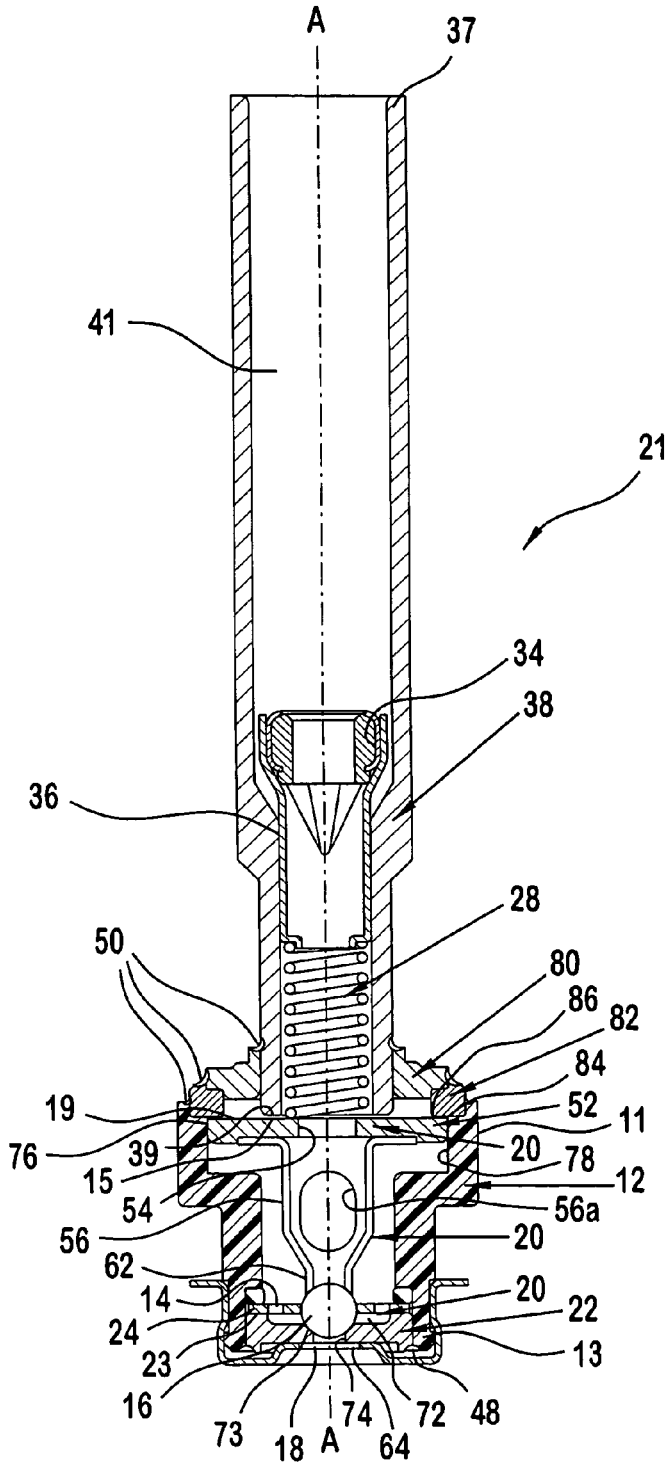
FIG. 3 is a cross-sectional view of a valve group subassembly of FIG. 1 prior to being inserted into a power group subassembly shown in FIG. 1.

FIG. 2 is an enlarged view of the first working air gap 15 and the second working air gap 86. The inlet tube 38 includes a lower surface 90 that is spaced apart a predetermined distance $d_1$ from the lower surface 90 to an upper surface 92 of the magnetic armature disk 52 along the longitudinal axis. Preferably, the upper surface 92 intersects the longitudinal axis A—A. This predetermined distance represents the first working air gap 15. A lower surface 84 of the magnetic stop member 82 is spaced a predetermined distance $d_2$ from the upper surface 92 of the magnetic armature disk 52. This predetermined distance represents the second working air gap 86 from the upper surface 92 to the lower surface 84 along the longitudinal axis. In a preferred embodiment, the distance $d_1$ is longer than the distance $d_2$.

In this preferred configuration, the coil 44 can be energized with a voltage potential (not shown) to generate an electromagnetic flux 88 that flows from the inlet tube 38, to the coil housing 60, through magnetic stop member 82, across the second working gap 86 to the armature disk 52, from the armature disk 52 across the first working gap 15, and back to the inlet tube 38. The flow of flux 88 through the first and second working air gaps generates an electromagnetic force in the first and second working air gaps in the direction of the longitudinal axis A—A that draws the armature assembly 20 against the force of the spring 28. The armature assembly 20 is displaced across the distance of the second working air gap 86 such that the upper surface 92 of the armature disk 52 contacts and is stopped by the lower surface 84 of the stop member 82. Because the stop member 82 directs the magnetic flux 88 through the second air gap 86 in the direction of the longitudinal axis A—A, the second air gap 86 constitutes a working air gap. Hence, the magnetic flux 88 flowing through the second working air gap 86 produces useful work in the form an electromagnetic force that attracts the armature disk 52.

Consequently, the stop member 82 can be considered to be a second stator member in addition to the first stator member 38 such that a second magnetic pole is formed at the second working air gap 86, in addition to the first magnetic pole, which is formed at the first working air gap 15. Because both air gaps 15 and 86 produce useful work, the efficiency of the magnetic circuit is believed to be increased as compared to known actuators that have one working air gap and one parasitic air gap.

Several features of the preferred embodiments facilitate an evenly distributed and miminal wear of the armature disk upper surface 92. The upper surface 92 of the armature contacting the lower surface 84 of the stop member 82, rather than contacting the lower surface 90 of the inlet tube 38, provides a contact area that is more distributed. The armature disk 52 includes a curved side surface 94 that is guided by the interior surface 78 of the valve body 12 as the armature assembly 20 is displaced along the longitudinal axis A—A. Because the side surface 94 is curved, the side surface 94 contacts the interior surface 78 along a line that extends 360° around the perimeter of the side surface 94. Due to limitations of manufacturing tolerances, the lower surface 84 of the stop member 82 and the upper surface 92 of the armature disk may not be exactly parallel to each other. The line contact between curved side surface 94 and interior surface 78 facilitates a slight tilting (e.g., a ball-in-ring geometry) for a three-degrees-of-freedom of the armature with respect to the longitudinal axis. This feature is believed to allow the lower surface 84 of the stop member 82 and the upper surface 92 of the armature disk, in a preferred embodiment, to contact each other in a plane, thereby for slight misalignment due to tolerances between the armature assembly 20 and the valve body 12. Preferably, the lower surface 84 of the stop member 82 and the upper surface 92 of the armature disk in the area of contact between theses two surfaces are coated with a layer of chrome to reduce wear of the respective surfaces. U.S. Pat. No. 6,499,668 discloses chroming techniques, and is incorporated by reference in its entirety. The combination of these features produces a consistent flow over the life of the injector.

Because the flux 88 flows through the stop member 82, rather than the valve body 12, the valve body 12 may be formed of a non-magnetic material such as a 300-Series stainless steel. Thus, the valve body may be formed by cost effective processes such as metal injection molding, stamping operations, or deep drawn operations.

In operation, fuel under pressure is provided to the upstream end 37 of the inlet tube 38 of the modular fuel injector assembly 10. The fuel flows through channel 41 and the fuel filter 34. From the fuel filter 34, the fuel flows through the adjusting tube 36 and past the spring 28. Once past the spring 28, the fuel passes through a hole 54 in the disk 52 through the armature tube 56 and through an aperture 56a of the tube 56 into the valve body 12. The fuel then flows through the plurality of apertures 14 in the lower guide 24 and is contained in the generally recessed area 72 of the seat 22 until the injector assembly 10 is energized. To discharge the fuel from the injector 10, the coil 44 is energized to create the electromagnetic flux 88 that flows from the inlet tube 38, to the coil housing 60, through magnetic stop member 82, across the second working gap 86 to the armature disk 52, from the armature disk 52 across the first working gap 15, back to the inlet tube 38. The flow of flux 88 through the first and second working air gaps 15 and 86 generates an electromagnetic force in the first and second working air gaps in the direction of the longitudinal axis A—A that draws the armature assembly 20 against the force of the spring 28. The armature/ball 20 assembly is displaced over the distance of the second working air gap 86 and guided by the interior surface 78 of the valve body 12 and lower guide 24 along the longitudinal axis A—A. The fuel that was contained in the recess 72 of the seat 22 is now free to flow through the circular hole 74 in the seat 22, through the orifice 64 and into the engine. When the voltage potential is removed from the coil 44, the electromagnetic flux 88 breaks down. The downward compressive force provided by the spring 28 forces the armature assembly 20 to drop back into the seat 22, thus preventing the flow of the fuel being metered.

As described, the preferred embodiments, including the method of manufacturing the modular injector are not limited to the preferred modular fuel injector described herein but can be utilized for other modular fuel injectors such as, for example, the modular fuel injector shown and described in U.S. Pat. No. 6,676,044 issued to Dallmeyer et al, on 13 Jan. 2004, the entirety of which is incorporated by reference into this application.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A modular fuel injector comprising:

a power group subassembly including:

a housing encasing an electromagnetic coil; and an overmold surrounding the coil and the housing;

a valve group subassembly including:

a first stator member that defines a fluid passage extending along a longitudinal axis;

a second stator member;

a non-magnetic shell disposed between the first and second stator members;

a valve body coupled to the second stator member, the valve body including a securement that secures the valve body to the coil housing;

an armature member disposed in the valve body, the armature member being coupled to a closure member and movable with respect to the first and second stator members between a first configuration with a closure member contiguous to a seat in the first configuration and spaced from the seat in the second configuration, the armature member having an armature surface with at least a portion contiguous to a plane intersecting the longitudinal axis, a first portion of the armature surface confronting the first stator member to define a first working gap from the armature surface to the first stator member along the longitudinal axis, and a second portion of the armature surface confronting the second stator member to define a second working gap from the armature surface to the second stator member along the longitudinal axis;

wherein the first working air gap having a first length in the direction of the longitudinal axis, the second working air gap having a second length in the direction of the longitudinal axis, and one of the first and second lengths is greater than the other of the first and second lengths.

2. The modular fuel injector according to claim 1, wherein each of the first and second portions of the armature surface comprises a generally planar surface.

3. The modular fuel injector according to claim 1, wherein the second working air gap is disposed radially outward from the first working air gap with respect to the longitudinal axis.

4. The modular fuel injector according to claim 3, wherein the first stator member comprises an inlet tube.

5. The modular fuel injector according to claim 4, wherein the second stator member is contiguous with the housing.

6. The modular fuel injector according to claim 1, wherein the armature member is contiguous with the second stator member and spaced from the first stator member in the second configuration.

7. The modular fuel injector according to claim 6, further comprising a chrome layer disposed on each of the first and second portions of the armature surface and the second stator member.

8. The modular fuel injector according to claim 1, wherein the closure member comprises a surface defining a portion of a sphere, and the seat comprises a surface defining a conic frustum.

9. The modular fuel injector according to claim 1, wherein the valve body includes a first surface, and the armature member includes a circumferential second surface, one of the first and second surface defining a line contact about the longitudinal axis on the other of the first and second surfaces.

10. The modular fuel injector according to claim 9, wherein the valve body comprises a non-magnetic material.

11. The modular fuel injector according to claim 9, wherein the non-magnetic material comprises a 300-series stainless steel.

12. The modular fuel injector of claim 1, wherein the first stator member comprises an inlet tube.

13. The modular fuel injector of claim 12, further comprising a filter assembly disposed in the inlet tube.

14. The modular fuel injector of claim 13, wherein the filter assembly comprises an adjusting tube and a filter, the adjusting tube contiguous to a wall surface of the inlet tube and the filter being spaced apart from the wall surface.

15. The modular fuel injector of claim 14, further comprising a resilient member having a first end contiguous to the armature surface and a second end contiguous to the adjusting tube.

16. The modular fuel injector of claim 15, further comprising another securement that secures the overmold to the inlet tube.

17. A method of manufacturing a modular fuel injector, comprising:

providing a power group subassembly having:

a housing coupled to an electromagnetic coil; and an overmold that surrounds the coil and the housing;

providing a valve group subassembly having:

a first stator member that defines a fluid passage extending along a longitudinal axis;

a second stator member;

a non-magnetic shell disposed between the first and second stator members;

a valve body coupled to the second stator member;

an armature member disposed in the valve body, the armature member coupled to a closure member contiguous to a seat disposed in the valve body, the armature member having an armature surface with at least a portion contiguous to a plane that intersects the longitudinal axis, a first portion of the armature surface confronting the first stator member to define a first working gap from the armature surface to the first stator member along the longitudinal axis with the first stator member, and a second portion of the armature surface confronting the second stator member to define a second working gap from the armature surface to the second stator member along the longitudinal axis;

wherein the first working air gap having a first length in the direction of the longitudinal axis, the second working air gap having a second length in the direction of the longitudinal axis, and one of the first and second lengths is greater than the other of the first and second lengths; and inserting the valve group subassembly into the power group subassembly; and securing the power group subassembly to the valve group subassembly.

18. The method of claim 17, wherein the securing comprises securing the coil housing to the valve body.

19. The method of claim 18, wherein the securing comprises securing the first stator member to the overmold.

* * * * *